United States Patent [19]

Dilley

[11] Patent Number: 4,655,264

[45] Date of Patent: Apr. 7, 1987

[54] TWIST TYING MACHINE

[75] Inventor: Gerald G. Dilley, Portland, Oreg.

[73] Assignee: Ben Clements & Sons, Inc., South Hackensack, N.J.

[21] Appl. No.: 807,638

[22] Filed: Dec. 11, 1985

Related U.S. Application Data

[62] Division of Ser. No. 545,993, Oct. 27, 1983, Pat. No. 4,559,977.

[51] Int. Cl.[4] ..... B21F 9/02

[52] U.S. Cl. ..... 140/93.6; 100/26; 100/31; 192/48.3; 192/48.92

[58] Field of Search ..... 140/93 A, 93.6; 53/138 A; 100/29, 31, 26; 226/143; 192/48.3, 48.92, 51

[56] References Cited

U.S. PATENT DOCUMENTS

| | | | |
|---|---|---|---|
| 2,651,900 | 9/1953 | Heilman | 100/29 |
| 2,888,666 | 4/1959 | Rogers | 100/31 |
| 3,318,230 | 5/1967 | Hilton | 100/4 |
| 3,428,096 | 2/1969 | Krylov et al. | 140/93.6 |
| 3,590,885 | 7/1971 | Ward | 140/93.6 |
| 3,718,526 | 2/1973 | Annis, Jr. | 100/29 |
| 3,898,416 | 8/1975 | Shotting et al. | 100/29 |
| 3,898,924 | 8/1975 | Mead et al. | 100/12 |
| 4,087,951 | 5/1978 | Tsuda et al. | 140/93 A |
| 4,177,842 | 12/1979 | Dilley | 140/93.6 |
| 4,252,157 | 2/1981 | Ohnishi | 140/93 A |
| 4,362,192 | 12/1982 | Furlong et al. | 140/93.6 |

FOREIGN PATENT DOCUMENTS 1945519 4/1970 Fed. Rep. of Germany .

2013117A 8/1979 United Kingdom .

*Primary Examiner*—Lowell A. Larson
*Assistant Examiner*—Robert Showalter
*Attorney, Agent, or Firm*—Blum Kaplan Friedman Silberman & Beran

[57] ABSTRACT

A ring encircles produce placed on a work table. Tie ribbon is fed by pressure rollers around the inner periphery of the ring to form a complete loop. A first gripper clamps and retains the free end of the ribbon against a second gripper. The pressure rollers operate in reverse retracting excess ribbon about the produce. A friction clutch, operative only for reverse ribbon feeding, allows for ribbon slippage as the ribbon tightens around the produce. Then the second gripper clamps the other end of the ribbon against a twister head and a twister mechanism rotates the clamped ends of the ribbon about a common axis twisting the ribbon ends together. Shearing edges sever the engaged ribbon from a ribbon supply during twisting. The grippers and twister mechanism are at ends of the concentric support rods and tubes, and the grippers in clamping move along the rotational axis of the twister mechanism. Axial gripper motion is provided by cylinder valves having pistons concentric with and supported by the gripper support rod or tube and acting, respectively at the ends of the gripper supports away from the tie ribbon. Rack and pinion mechanisms provide rotation of the twister mechanism and forward and reverse feeding of the ribbon. All components are pneumatically driven. The design accommodates normal wear and temperature variations without adjustment.

15 Claims, 14 Drawing Figures

TWIST TYING MACHINE

This is a division of application Ser. No. 545,993 filed Oct. 27, 1983, now U.S. Pat. No. 4,559,977.

BACKGROUND OF THE INVENTION

This invention relates generally to a tying machine as used for tying a group or bundle of items, for examples, celery, asparagus, broccoli and the like, and more particularly to a twist tying machine which operates on compressed air and without the use of electrical devices, complex camming and other timing mechanisms. Prior art patents teach the development of machines which effectively apply a tie wire about products such as asparagus, broccili, celery stalks, to protect those products in transit prior to retail sale. The tie is a malleable wire sandwiched between two strips of paper secured together, for example, with adhesive, to form a flat tie ribbon. After a snug loop of ribbon is formed around the product, the ends of the ribbon are clamped. These clamped ends are then rotated about a central axis producing permanent twists in the tie ribbon whereby the loop and product are held together. In the known manner, the ribbon can be untwisted by the purchaser of the product and retwisted when it is desired to reapply the ribbon. These procedures have become most familiar to consumers in this country with twist ties being used on many products, not only to hold the above-mentioned products together but to provide closures for paper and plastic bags containing food stuff such as bread, and in larger sizes for bags used, for example, for containing potatoes, onions, etc. Many operational steps are required to apply a twist tie, in the form of a wire/paper ribbon. In the past, complex machinery has been designed to effect performance. These machines, as illustrated, for examples, in U.S. Pat. Nos. 3,318,230, issued May 9, 1967; 3,428,096, issued Feb. 18, 1969; 3,898,924, issued Aug. 12, 1975, and 4,177,842, issued Dec. 11, 1979, are machine constructions relying on complex mechanisms, electrically driven in some instances, and generally using cam devices to provide sequential motions necessary to the procedural steps in applying a twist tie ribbon to the product. Each progressive patent teaches an improvement in performance and simplification in structure, however, reliance on cams for critical motions, for example, in gripping the ends of the ribbon prior to twisting, and in cutting the ribbon after gripping is prevalent. Endless belt chain drives, pulleys, complicated linkage systems are not uncommon and the need for adjustment for operation and to compensate for temperature variations and for wear is relatively frequenct. Use of both a forward feed drive for the ribbon and also an independent reverse feed drive for tightening the ribbon about the bundle is also disclosed in the prior art, adding to complexity.

What is needed is a twist tying machine which is simple and reliable in construction, and reducing the total number of parts, and the need for precise timing and critical mechanical interrelationships requiring frequent adjustment.

SUMMARY OF THE INVENTION

Generally speaking, in accordance with the invention, a twist tying machine especially suitable for tying bundles of produce is provided. When the produce is placed on a work table at the preferred position, a ring encircles the bundle and the tie ribbon is fed by pressure rollers around the inner periphery of the ring to form a complete loop. Then a first gripper clamps and retains the free end of the ribbon encircling the produce against a second gripper. The same pressure rollers which feed the ribbon from a supply drum then operate in reverse to retract excess ribbon from the ring and provide a snug fit for the ribbon about the produce. A friction clutch, operative only for reverse feeding of the ribbon allows for slippage as the ribbon tightens around the produce and damage to the produce is prevented. Then the second gripper clamps the other, attached end of the ribbon against a twister head such that both ends of the ribbon are now constrained. A twister mechanism rotates the clamped ends of the ribbon about a common central axis so that the wire within the ribbon is twisted and the ribbon ends are joined together in the process of twisting. Shearing edges in the twister mechanism sever the engaged ribbon from the ribbon supply as the ends are twisted. The grippers and twister mechanism are at ends of concentric support rods and tubes, and in gripping the ribbon ends, respectively, the grippers move axially of the rotational axis of the twisting mechanism. Axial gripper motion is provided by pancake-type cylinder valves having pistons concentric with and supported by the gripper support rod or tube and acting, respectively at the ends of the gripper supports away from the tie ribbon. These valves, the friction clutch for reverse feeding of the tie ribbon, and all other operations of the mechanism are pneumatically powered. Rack and pinion mechanisms provide rotation of the tie twister mechanism and forward and reverse feeding of the ribbon around the product to be tied. The design accommodates normal wear and temperature variations without adjustment.

Accordingly, it is an object of this invention to provide an improved twist tying machine which is simple and reliable in operation.

Another object of this invention is to provide an improved twist tying machine which has a minimum number of parts, is simple to construct and requires little maintanence.

A further object of this invention is to provide an improved twist tying machine which is pneumatically operated and provides safety for the operator.

Still another object of this invention is to provide an improved twist tying machine which allows for adjustment in the size of bundle which may be tied and allows control of the pressure placed on the produce by the tie ribbon.

Yet another object of this invention is to provide an improved twist tying machine which automatically accommodates for wear and temperature variations.

Still other objects and advantages of the invention will in part be obvious and will in part be apparent from the specification.

The invention accordingly comprises the feaures of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 13:
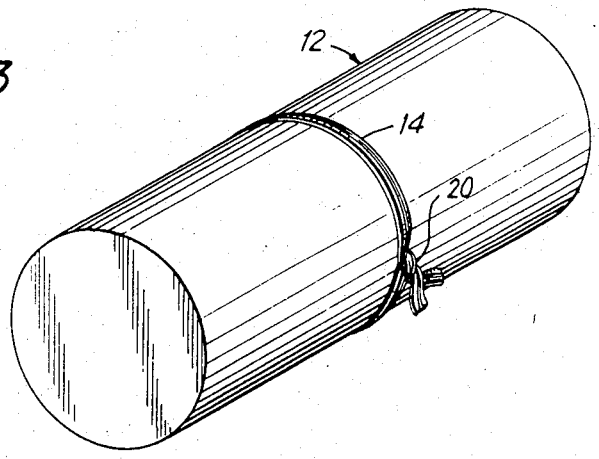
FIG. 13 is a perspective view illustrating the bundle of FIG. 12 after the ribbon has been tied therearound.

Operation of the twist tying machine 10 in accordance with the invention is generally known from the above cited patents which are incorporated herein by reference. In particular, a product 12 (FIG. 13), for example, a bundle of asparagus stalks, a bunch of celery or broccili, a rolled up newspaper, is held together by a tie ribbon 14 which consists of a strand of wire 16 (FIG. 5) sandwiched between two flat paper strips 18 which are adhesively joined together. The paper strips 18 may be replaced with thin plastic strips joined together. A length of tie ribbon 14 encircles the product 12 and the wires twisted as at 20. Because the wire is malleable and takes a set when twisted, the product 12 remains encircled until the tie ribbon 14 is untwisted by the product consumer.

With reference to the Figures, the twist tying machine 10 in accordance with the invention comprises an enclosure 22 supported on a floor pedestal 24 and having a horizontal work table 26 extending from the enclosure 22. A head assembly 28 is exposed at the front of the enclosure 22 adjacent to the horizontal work table 26.

Figure 9:
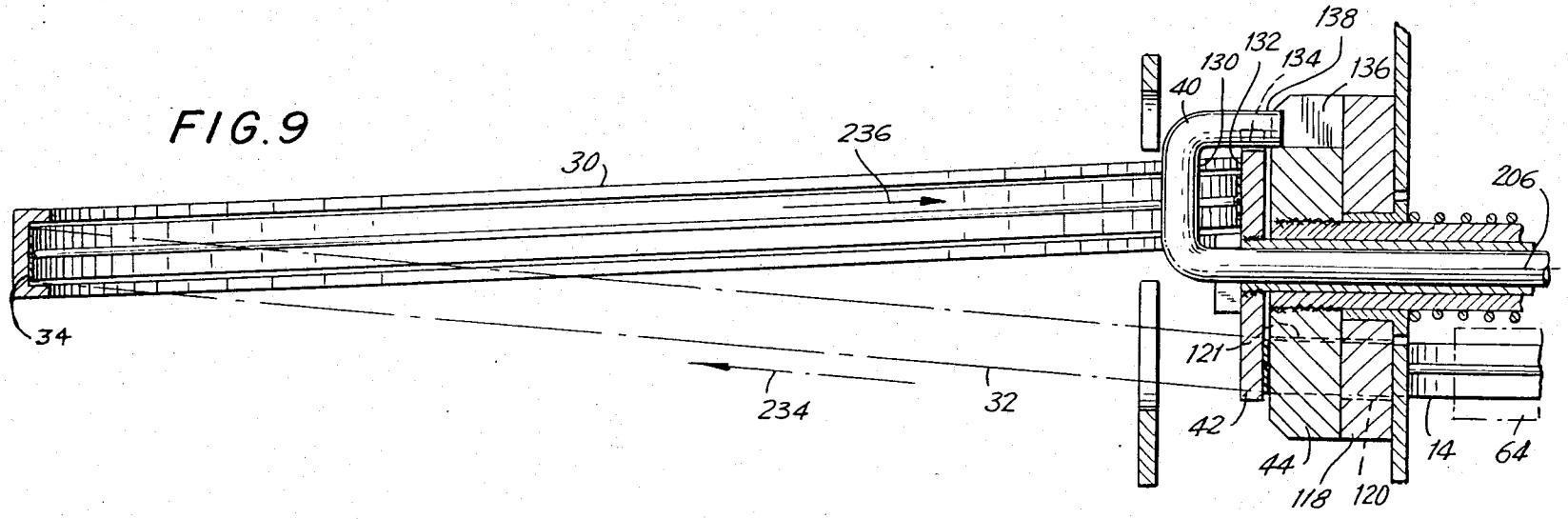
FIG. 9 is a view taken along the line 9—9 of FIG. 3.

The head assembly 28 includes a lower ring 30 almost entirely below the plane surface 58 of the table 26 and an upper ring 32. As in the prior art, the product 12 to be tied is placed on the horizontal table 26 adjacent to the head assembly 28. The upper ring 32 is pivoted downwardly to encircle the product 12, forming by connection with the lower ring 30 a single continuous loop of a helix (FIG. 9). Both the upper ring 32 and the lower ring 30 include an inner guide channel 34 dimensioned to continuously guide the tie ribbon 14 around the ring. The tie ribbon 14 enters the head assembly 28, as described more fully hereinafter, and moves around the upper ring 32 in the channel 34 and passes through the lower ring 30 to complete a helical loop around the product.

The tie ribbon 14 is supplied continuously from a ribbon supply drum 36, mounted to the pedestal structure 24 below the enclosure 22. A length of ribbon 14 sufficient to follow the inner ring periphery is fed for each item of product. After feeding around the channel 34 as described above, the leading end 38 of the ribbon 14 is engaged by a first gripper 40 and held in position against a second gripper 42. Then, the attached end of the loop of tie ribbon 14 is withdrawn from the ring until the tie ribbon tightens around the product 12. At that time, the attached end of the ribbon 14 is constrained against a twister head 44 by the second gripper 42. Then the twister head 44, to which both grippers 40, 42 are connected while the ends of the ribbon are fixedly restrained, is rotated, twisting the ends of the tie ribbon 14 with respect to each other and producing the tie as indicated at 20 in FIG. 13.

As the twister head 44 rotates, the attached end of the tie ribbon 14, that is, the end connected back to the ribbon supply drum 36, is severed by a knife edge acting between the rotating twister head 44 and a stationary portion of the head assembly 28. The upper ring 32 is raised and the tied product 12 is removed from the work table 26. The operation may then be repeated on the next product. Initiation of the tie operation is accomplished in the illustrated embodiment (FIG. 1) by a foot pedal valve 46.

The twist tying machine 10 in accordance with the invention is now described in greater detail.

HELICAL RING

Figure 2:
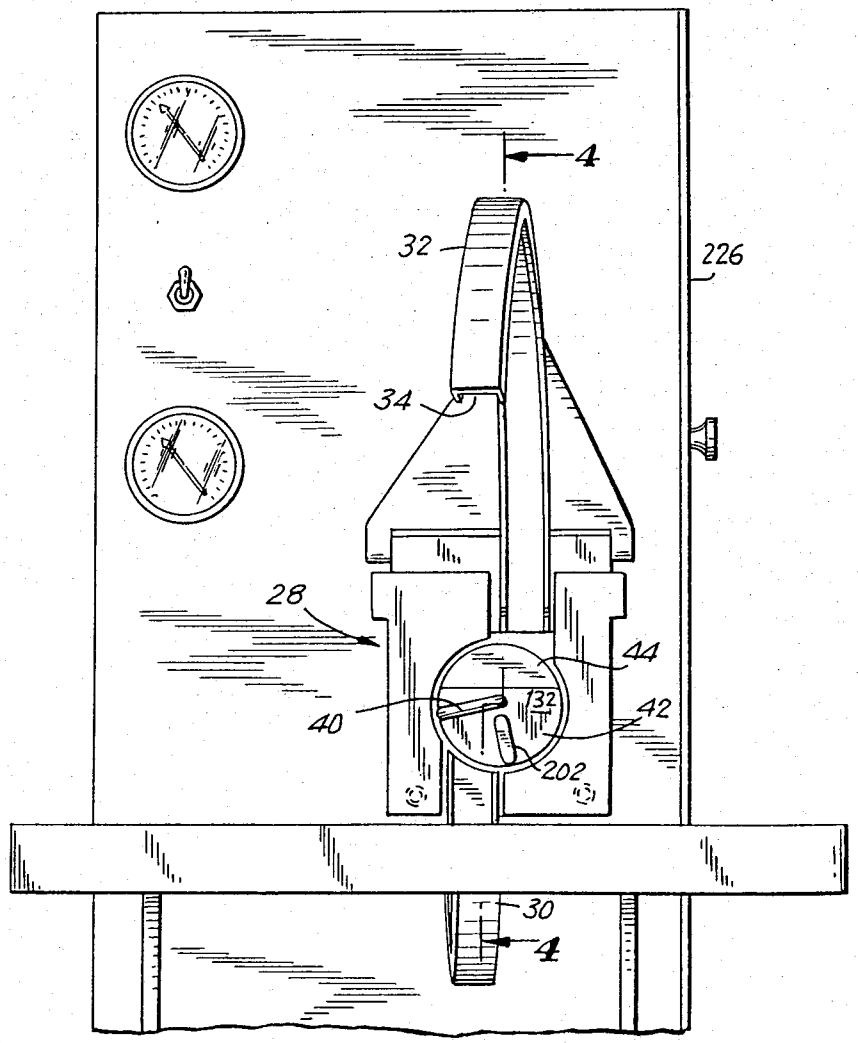
FIG. 2 is a partial front view to an enlarged scale of the twist tying machine of FIG. 1.
Figure 3:
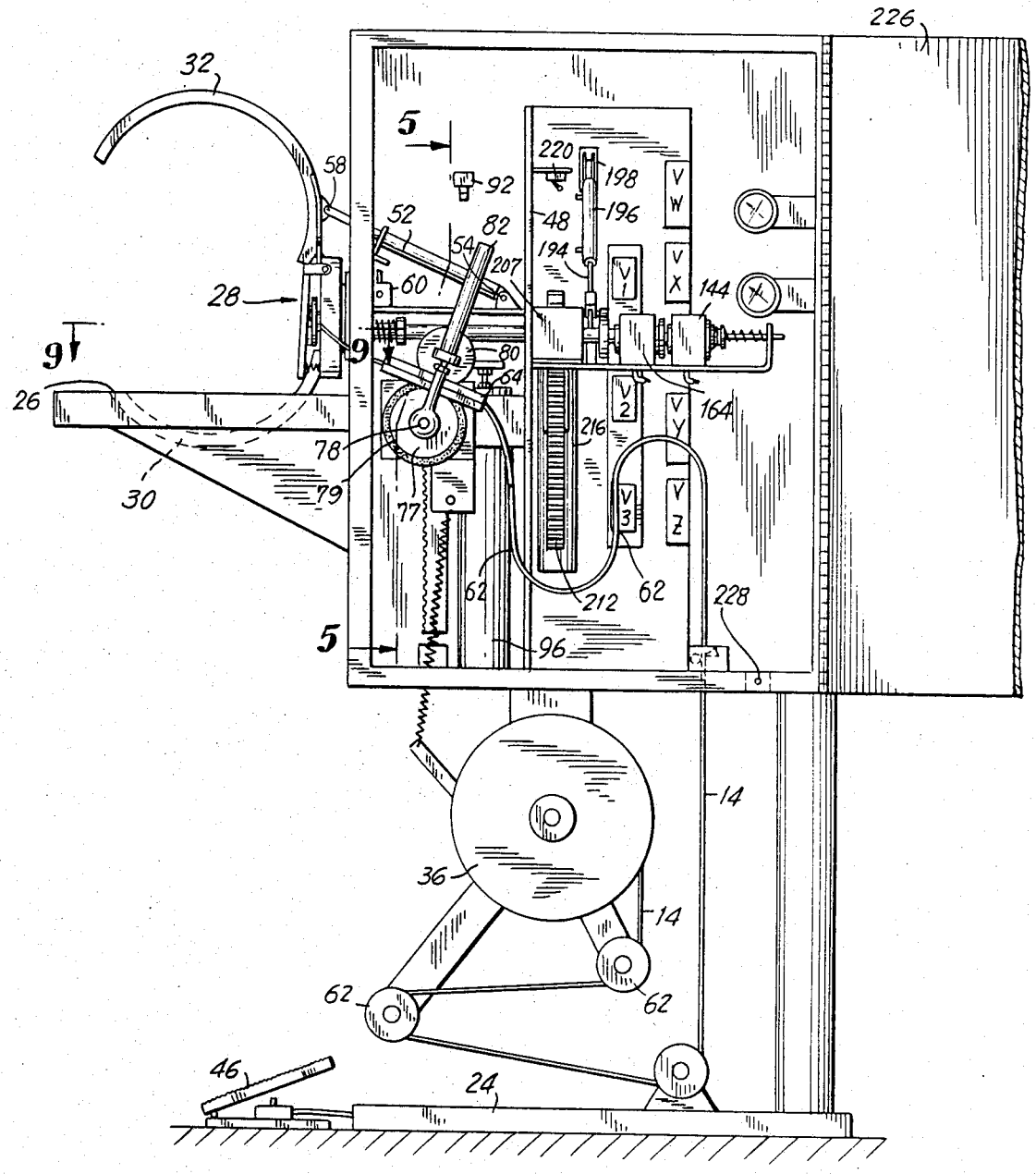
FIG. 3 is a side elevational view of the twist tying machine of FIG. 1 with the door in an open position.
Figure 4:
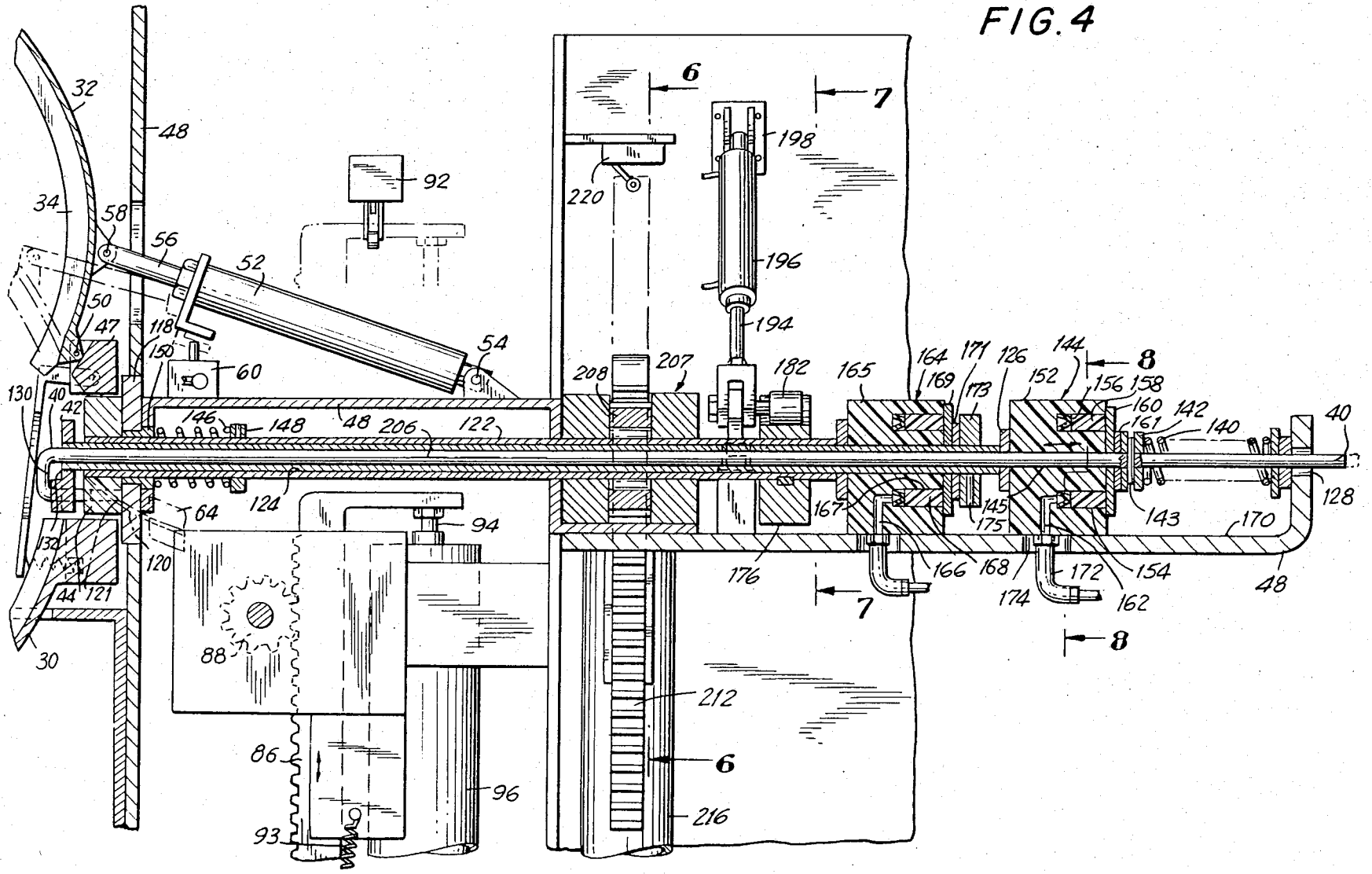
FIG. 4 is an elevational view in section to an enlarged scale taken along the line 4—4 of FIG. 2.

As best illustrated in FIGS. 1-3 and 9-12, the upper ring 32 is pivotably mounted to a block portion 47 and to a frame 48 by means of a pivot pin 50 adjacent to the twister head 44. A pneumatic ring cylinder 52 is pivotably mounted to another portion of the frame 48 at one end by a pivot pin 54 (FIG. 4) and a piston rod 56 of the cylinder 52 is pivotably connected to the upper ring 32 by a pivot pin 58 (FIG. 4). When the ring cylinder 52 is actuated by application of pressurized air, the piston rod 56 extends from the cylinder body 52 and pivots the upper ring 32 from the elevated position shown in FIGS. 1-3 to the closed position shown in FIGS. 11 and 12. Therein it is illustrated that the upper ring 32 joins the lower ring 30 substantially at the plane of the table 26 whereon the product 12 is rested for tying. A single guide channel 34 is formed around the inner periphery of the closed ring which is in the form of a helix (FIG. 9). A ring limit valve 60 detects operation of the ring cylinder and the downward position, indicated with broken lines in FIG. 4, of the upper ring 32.

A guard bar 53 is also pivotably mounted at one end to the block portion 47 by means of a pivot pin 55, the other end of the guard bar 53 being resiliently supported by a spring 57. The guard bar 53 serves to prevent the product 12 from engaging directly with the grippers 40, 42 (FIG. 12) possibly incurring damage, and the spring 57 cushions the product while it is positioned on the table surface. Additionally, by holding the product apart from the twisting mechanisms, lengths of tie ribbon 14 are provided to be twisted without crushing the product 12.

TIE RIBBON FEED

The tie ribbon 14 is threaded from the ribbon supply drum 36 around tensioning rollers and guidebars, all generally indicated with reference numerals 62, until it reaches a ribbon feed chute 64 (FIGS. 3,5), including a flat lower plate 66 and an upper plate 68 having a shallow channel 70 formed in the mating surface between the upper and lower plates 66, 68. The plates are held together by screws 71 leaving the channel 70 wherethrough the tie ribbon 14 feeds. Openings 72, 74 through the upper and lower plates 68, 66 respectively, allow access to the flat surface of the tie ribbon 14 from above and below.

In feeding the tie ribbon 14, a lower feed wheel 76 connected to a shaft 78 enters the opening 74 in the lower plate 66 of the ribbon feed chute 64 to press on the underside of the tie ribbon 14. The lower feed wheel 76 comprises an aluminum disc 77 with a resilient polyurethane tire 79 around the disc periphery. An upper feed wheel 80 mounted on a shaft 81 presses on the upper surface of the tie ribbon 14 through the opening 72 in the upper plate 68 of the ribbon feed chute 64. The contacting surface of the wheel 80 may be knurled.

Figure 14:
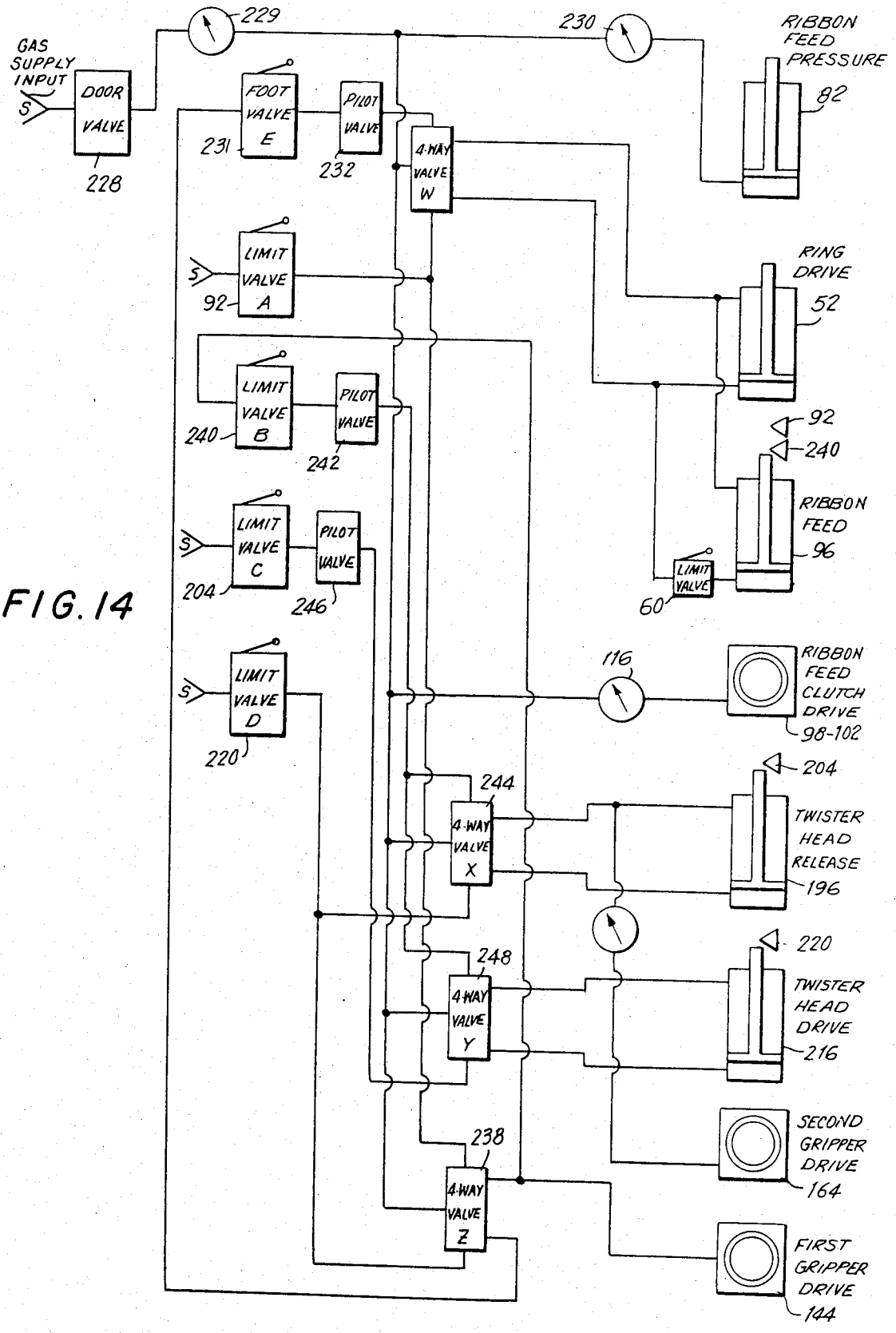
FIG. 14 is a diagram of the pneumatic circuits in the twist tying machine in accordance with the invention.

The shaft 81 is connected to the body of a feed pressure cylinder 82 having its plunger rod 84 connected to the shaft 78 on which the lower feed wheel 76 is mounted. Thus, when the feed pressure cylinder 82 is actuated to extend the rod 84 from the cylinder body 82, as indicated by the arrows and broken lines in FIG. 5, the upper feed wheel 80 is separated from the tie ribbon 14 and feeding of the ribbon is not possible. When pneumatic pressure is applied to the feed pressure cylinder 82 and the rod 84 is withdrawn as illustrated in solid lines in FIG. 5, sufficient pressure is applied to the tie ribbon 14 between the upper feed wheel 80 and the lower feed wheel 76 such that when the feed wheel 76 is rotated, the tie ribbon 14 is fed through the chute 64 to the head assembly 28. Pressure to the cylinder 82 is adjustably controlled by a regulator 230 (FIG. 14) to apply the desired friction for moving the ribbon 14.

Figure 5:
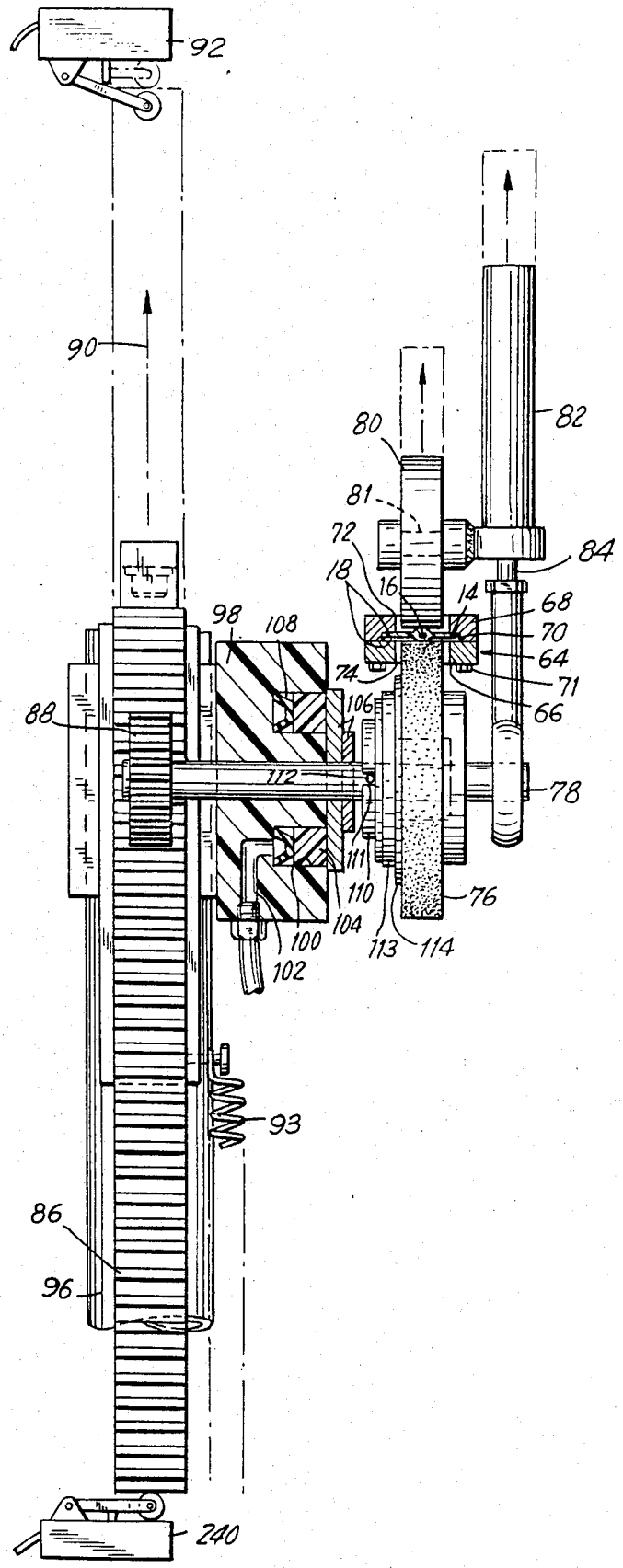
FIG. 5 is a view to an enlarged scale taken along the line 5—5 of FIG. 3.

A ribbon feed rack 86 extends transversely to the shafts 78, 81 and a pinion 88 fixedly connected to the shaft 78 engages the teeth of the rack 86. Thus, when the rack moves in the direction indicated by the arrow 90, the pinion 88 rotates the shaft 78 which in turn rotates the lower feed wheel 76 which is in frictional engagement with the tie ribbon 14 in the chute 64. When the upper feed wheel 80 is also pressed against the tie ribbon 14, the ribbon 14 is fed through the chute, out of the plane of the paper as illustrated in FIG. 5, toward the head assembly 28. The rack 86 travels until engaging a feed limit valve 92, actuation of valve 92 causing the direction of motion of the rack 86 to reverse. Thus, the length of ribbon 14 which is fed in a single operation of the rack 86 is determined by physical positioning of the feed limit valve 92, which positioning is variable.

Figure 6:
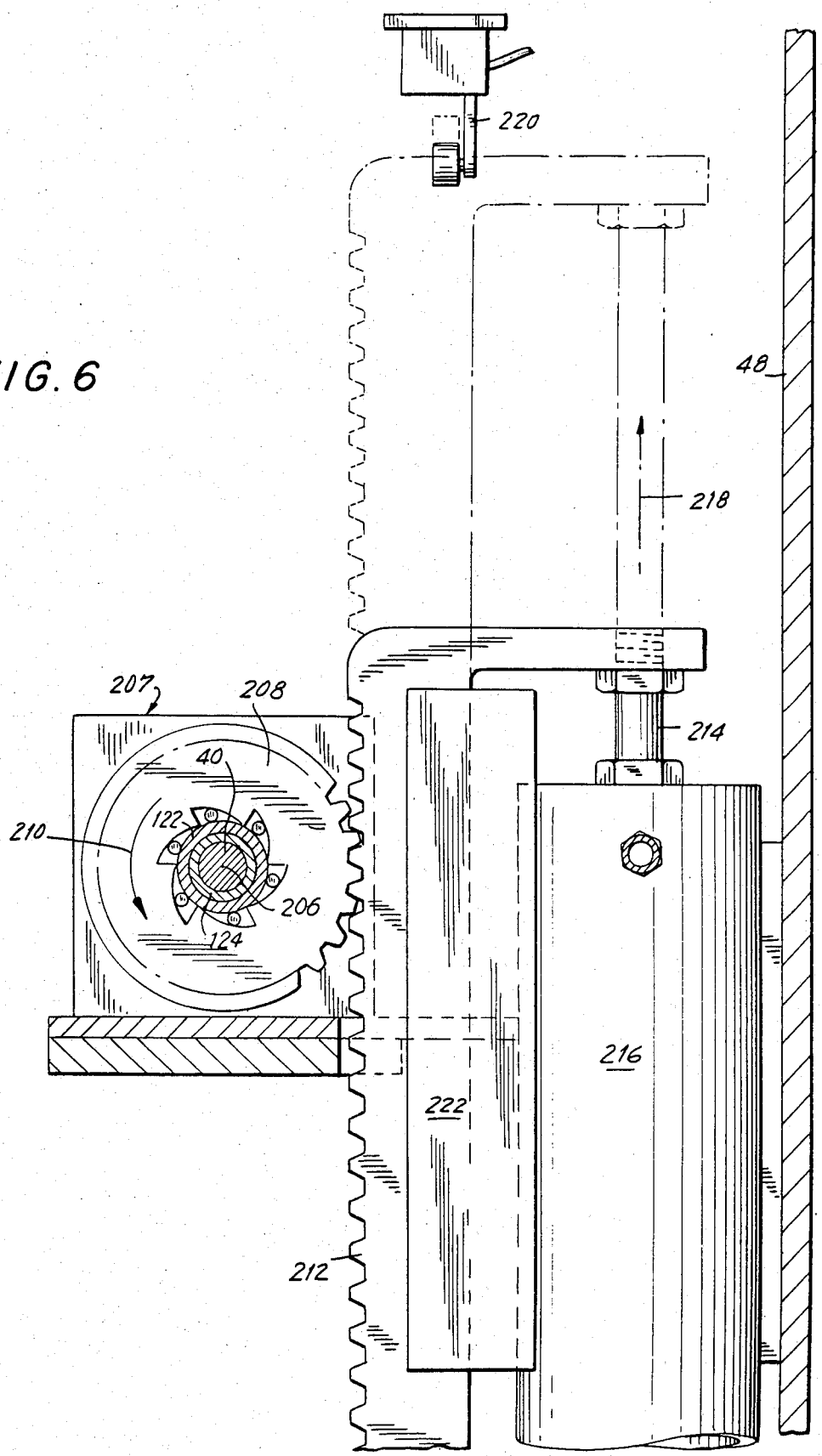
FIG. 6 is a further enlarged view taken along the line 6—6 of FIG. 4.

As best illustrated in FIGS. 4, 5 the feed rack 86 is driven against the tension of a spring 93 opposing extension of a plunger rod 94 from a pneumatic ribbon feed cylinder 96. Actuation of the limit valve 92 at the end of travel of the rack 86, causes reverse operation of the ribbon feed cylinder 96, withdrawing the plunger rod 94 and causing the rack 86 to move in the direction opposite from the arrow 90. The lower feed wheel 76, which provided positive traction on the tie ribbon 14 when the rack 86 moves in the direction of the arrow 90, is mounted to the shaft 78 by device, for example, a Torrington 1-way clutch, such that the lower feed wheel 76 is able to rotate freely relative to the shaft 78 when the rack 86 moves downward. FIG. 6 illustrates a similar one-way drive for the pinion 208 described hereinafter.

Also mounted concentrically with the shaft 78 is a block cylinder having a body 98 including an annular channel 100 concentric with the shaft 78 to which pneumatic pressure is fed by means of an internal duct 102. A piston 104 which fits in the annular channel 100, presses on concentric discs 106 which are slideably supported for translation on the shaft 78. An annular flexible diaphragm 108 having a generally U-shaped crossection fits in the annular channel 100 providing a sliding pressure seal with the side walls thereof. When pressure is applied to the internal duct 102, the diaphragm 108 slides in the channel 100 driving the piston 104 outward and the concentric discs 106 along the shaft 78 until engagement is made with a thrust plate 110 having a shoulder. The thrust plate 110 is mounted for rotation with the shaft 78 by means of a pin 112 extending transversely from the shaft 78 and engaging a groove 111 in the thrust plate 110. A clutch disc 113 slidingly mounted on the shaft-78 rotates with the thrust plate 110 and opposes a mating clutch plate 114 concentrically mounted to the lower feed wheel 76 for frictional engagement with the moving clutch plate 114. The degree of frictional engagement between the clutch plates 113, 114 is set by means of a pressure regulator 116 (FIG. 14) which supplies gas to the internal duct 102. Thus, a direct drive for the tie ribbon 14 is provided by the lower feed wheel 76, shaft 78 and rack and pinion, 86, 88 when the tie ribbon 14 is advanced to encircle the product 12, and a friction drive is provided for the lower feed wheel 76 by way of the pin 112, thrust plate 110 and clutch elements 113, 114 when the tie ribbon 14 is withdrawn so as to tighten a loop of ribbon 14 about the product 12, as described hereinafter, when the rack 86 is operated in the reverse direction.

The first plate 110 rotates with the shaft 78 when the rack 86 moves up to advance the tie ribbon 14 and also when the rack 86 moves down to withdraw the excess amount of tie ribbon encircling the product 12. The two frictional clutch elements 113, 114, rotate in synchronism such that there is no angular relative motion between them and no wear when the ribbon feeds out.

The groove 111 in the thrust plate 110, providing a sliding axial connection between the pin 112 and the thrust plate 110 rather than a rigid fixed connection, allows for variation in the positioning along the shaft 78 of the elements 110, 113 with temperature changes which occur as a result of the frictional slippage between the clutch elements 113, 114 during operation of the machine in retracting ribbon from the loop. Because of this sliding connection between the pin 112 and the groove 111, dimensional variations due to temperature changes do not result in changes in the frictional engagement between the driving clutch disc 113 and the driven clutch plate 114. It is not necessary as the temperature changes to modify the level of pressure activating the piston 104 to engage the lower feed wheel 76 for its reverse operation. Ribbon tension is therefore uniform.

HEAD ASSEMBLY

As indicated earlier, the purpose of the head assembly generally indicated at 28 (FIG. 1) is to encircle a product 12, resting on the work table 26, with a tie ribbon 14, then to draw the tie ribbon 14 snugly about the product and to twist the ends of the tie ribbon 14 such that the product is tied, and finally to shear the tied ribbon from the source of ribbon supply so that the operation may be repeated.

As illustrated in FIGS. 2 and 4, the head assembly includes a cutter plate 118 fixedly mounted to the frame 48 and having a slot 120 through which the ribbon 14 emanating from the ribbon feed chute 64 is threaded.

The twister head 44 is fixedly connected to a twister tube 122 which extends through a central opening in the cutter plate 118. The second gripper 42 is fixedly connected to a hollow tube 124 which extends concentrically through the twister tube 122 and terminates against a thrust bearing 126.

The first gripper 40 is a long rod which extends concentrically through the second gripper tube 124 and twister tube 122 to be supported on a bearing 128 mounted on the frame 48. The forward end of the first gripper at the head assembly 28 is bent in a hook shape having a contact surface 130 which is substantially parallel to a surface 132 on the second gripper 42.

As best seen in FIG. 9, notches 134, 136 are provided in the second gripper 42 and twister head 44 respectively for receiving therein the free end 138 of the hooked portion of the first gripper 40. When the free end 138 of the first gripper 40 is engaged in the notches 134, 136, angular motion between the first gripper 40, second gripper 42 and twister head 44 is blocked about the common concentric axis through the cutter plate 118. Nevertheless, a spring 140 mounted between the frame 48 and a thrust collar 142 mounted on the first gripper 40 biases the first gripper away from the second gripper 42 as seen in FIGS. 4 and 9. A pin 143 through the first gripper 40, a circular rod, fixes the position of the thrust collar 142. A first gripper cylinder 144, similar in construction to the actuator 98–106 for the frictional ribbon feed (FIG. 5), has a through-hole 145 concentric with a piston 158 and diaphragm 156. The straight rod portion of the first gripper 40 passes through the hole 145.

The twister head 44 is urged against the cutter plate 118 by a spring 146 acting between the frame 48 and a collar 148 positioned along the twister tube 122. The twister tube 122 is supported where it passes through the cutter plate 118 by a thrust bearing 150.

The first gripper cylinder 144 is of a design similar to the cylinder 98, 104, 108 described in relation to the friction drive for feeding the tie ribbon 14. The first gripper cylinder 144 comprises a block 152 including an annular channel 154 having a diaphragm 156 sealingly fitted therein. The piston 158 seats in the channel 154 and presses against a circular metal plate 160 and thrust washers 161 positioned between the piston 158 and the pin 143 through the first gripper 40. When pressurized gas is provided to the annular chamber 154 through a duct 162, the diaphragm 156, piston 158 and circular plate 160 move outwardly of the cylinder block 152 (to the right as seen in FIG. 4) pushing the pin 143 and consequently the first gripper 40 against the force of the spring 140 until the first gripper surface 130 on the hooked end presses against the mating surface 132 on the second gripper 42. The cylinder block 152, though having a small clearance or sliding contact with the frame surface 170, does not move toward the hooked end of the first gripper because the thrust bearing 126 is fixed against motion in that direction as explained hereinafter.

A second gripper cylinder 164 is constructed in a manner similar to the first gripper cylinder 144. The first gripper 40 and second gripper tube 124 pass through the center of the valve block 165 concentrically with the annular channel 167. When the second gripper cylinder 164 is pressurized through a duct 166, a piston 168 extends and a plate 169 pushes through a thrust washer 171 against a disc 173 held to the second gripper tube 124 by a pin 175. This action pushes the collar 126 attached to the end of the second gripper tube 124 against the block 152 of the first gripper cylinder 144, translating the block 152. Thereby the second gripper 42 moves against the twister head 44. However, when the second gripper 42 moves against the twister head 44, the first gripper 40 remains in continuous contact with the second gripper 42 at the contacting surfaces 130, 132 as displacement of the block 152 allows the first and second grippers 40, 42 to move substantially in unison when pneumatic pressure is concurrently applied to the ducts 162, 166 in the first and second gripper cylinders 144, 164.

In summarizing, the first gripper cylinder 144, is free to slide on the upper surface 170 of the frame 48. It should be noted that the pneumatic hose 172 passes through a slot 174, rather than a hole, in the frame 48 to facilitate such sliding. The thrust bearing 126 at the end of the second gripper tube 124 abuts the block 152 of the first gripper cylinder 144 both prior to actuation of the cylinder 144 and also after such actuation. When the second gripper cylinder 164 is actuated, the second gripper 42 moves to contact the twister head 44 by translation of the cylinder block 152 on the surface 170 of the frame 48. Thus, the first gripper 40 follows the second gripper 42 to the right (FIG. 4) when the second gripper 42 moves to the twister head 44. Thus, as explained more fully hereinafter, the tie ribbon 14, engaged at the free end between the first and second grippers 40, 42, is not released when the second gripper 42 moves to the twister head 44.

When wear occurs at the gripping surfaces, automatic compensation is provided without adjustment by the pneumatic cylinders 144, 164 which always extend the pistons until the desired abutments bring motion of the grippers 40, 42 to a stop.

The blocks and pistons of the cylinders 144,164 (and block 98 and piston 104, FIG. 5) may be of any suitable metal, e.g. aluminium, or plastic, e.g. Delrin, for quiet operation.

TWISTING

So as to provide proper alignment of the grippers 40, 42 and the twister head 44 relative to the upper and lower rings 32, 30, the rotational position of the twister head 44 relative to the cutter plate 118 is fixed by means of a locking disk 176 fixedly connected (FIG. 7) by a key 178 to the twister tube 122. The locking disc 176 is substantially circular at its outer periphery and has a semi-circular notch 180 for receiving a lock roller 182 therein. The lock roller 182 is mounted for rotation on a pin 184 fixedly connected to a linkage lever 186 which lever is pivoted at one end to the frame 48 by way of a gusset 190 and pivot pin 192. The other end of the lever 186 is pivotably connected to the plunger rod 194 of a locking cylinder 196 which in turn pivotably connects to the frame 48 by means of a gusset 198 and pivot pin 200.

Figure 7:
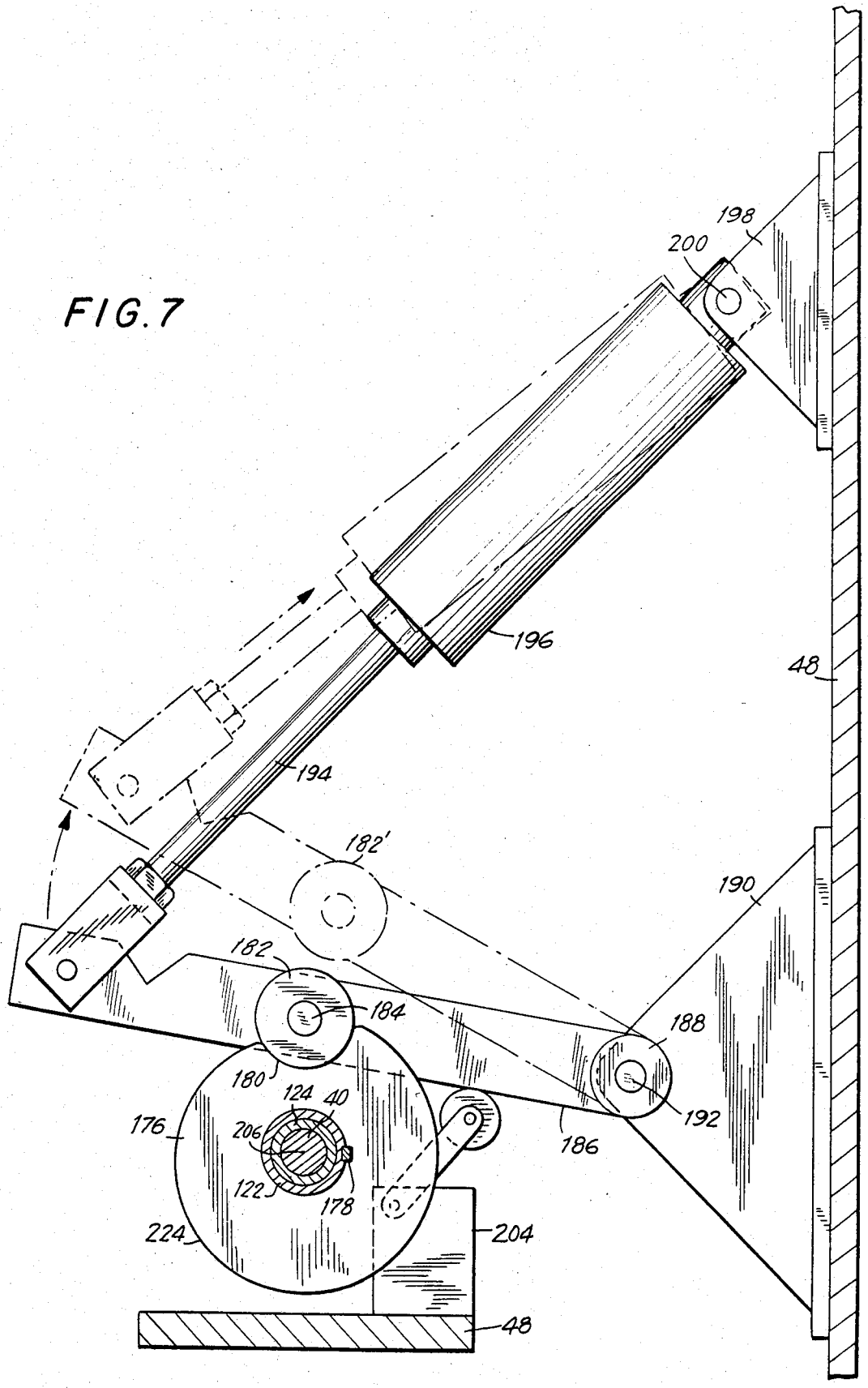
FIG. 7 is a view to a further enlarged scale taken along the line 7—7 of FIG. 4.
Figure 8:
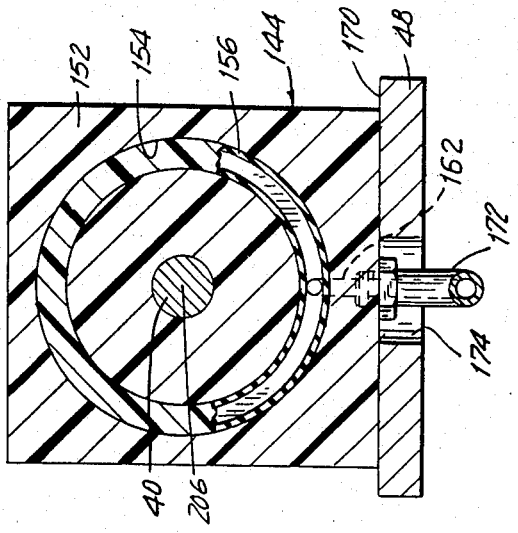
FIG. 8 is a view to an enlarged scale taken along the line 8—8 of FIG. 4.

Normally, the plunger rod 194 is extended as illustrated with the solid lines in FIG. 7 with the lock roller 182 seated in the semi-circular notch 180 of the locking disc 176. Accordingly, the twister tube 122 and the first and second grippers 40, 42 are rotationally fixed. In this condition, these elements are oriented as seen in FIG. 2, with a guide bar 202 on the face of the second gripper 42 positioned for deflecting the tie ribbon 14 exiting from the lower ring 30 toward the hook on the first gripper 40. As stated above, the hook of the first gripper 40 is displaced from the surface 132 of the second gripper 42 but the free end 138 on the hook is engaged with both the second gripper 42 and twister head 44 (FIG. 9).

A limit switch 204 detects the position of the lever 186. When the plunger rod 194 is withdrawn into the locking cylinder 196, as indicated with the broken lines in FIGS. 7, the lock roller 182 moves out from the notch 180 as the lever 186 pivots. Therefore, the locking disc 176 is enabled for rotation about the longitudinal axis 206 of the first gripper 40.

A pinion 208 is also connected to the twister tube 122 by way of a one-way drive drive, for example a Torrington 1-way clutch as illustrated in FIG. 6. Such a device is not a novel portion of this invention and needs no detailed description here Suffice it to say that when the pinion 208 rotates in the direction of the arrow 210 (FIG. 6), the twister tube 122 is rigidly joined to the pinion 208 and rotates therewith. However, when the pinion 208 rotates in a direction opposite to the arrow 210, the pinion 208 rotates free of the twister tube 122.

The pinion 208 engages a rack 212 which is driven by the plunger rod 214 extending from a twister cylinder 216. When the cylinder 216 is actuated by pneumatic pressure, the rack 212 travels in the direction of the arrow 218, striking a twister limit switch 220 during the complete travel of the rack 212 wherein the pinion 208 makes two complete rotations. Thus, the first gripper 40, second gripper 42 and twister head 44 rotate in unison. A rack guide 222 aligns the rack and assures proper engagement with the pinion 208.

When the pinion 208 has completed approximately 1½ revolutions, tripping the switch 220 causes the locking cylinder 196 to actuate extending the plunger rod 194 such that the lock roller 182 makes contact with the outer periphery 224 of the locking disc 176. As the pinion 208 continues to rotate, the roller 182 travels along the moving surface 224 until, upon completion of the second revolution, the lock roller 182 falls into the semi-circular notch 180 and further rotation of the grippers 40, 42 and twister head 44 is prevented.

Through the action of the one-way drive associated with the pinion 208, no turning of the grippers 40, 42 or twister head 44 occurs when the rack 212 is returned to its starting position by withdrawal of the plunger rod 214 within the twister cylinder 216.

It should be noted that all of the cylinders and switches described above are pneumatic and no electric motors, switches, or other devices are used. A door 226 on the enclosure 22 engages a door valve 228 which when the door is closed applies pneumatic pressure from an external source (not shown) to the feed pressure wheel cylinder 82 bringing the upper feed wheel 80 into contact with the tie ribbon 14 and providing the necessary frictional engagement between the tie ribbon 14 and lower feed wheel 76. Pressure to the feed cylinder 82 is applied through an adjustable regulator 230 so that friction on the tie ribbon 14 is controllable.

OPERATION

Figure 1:
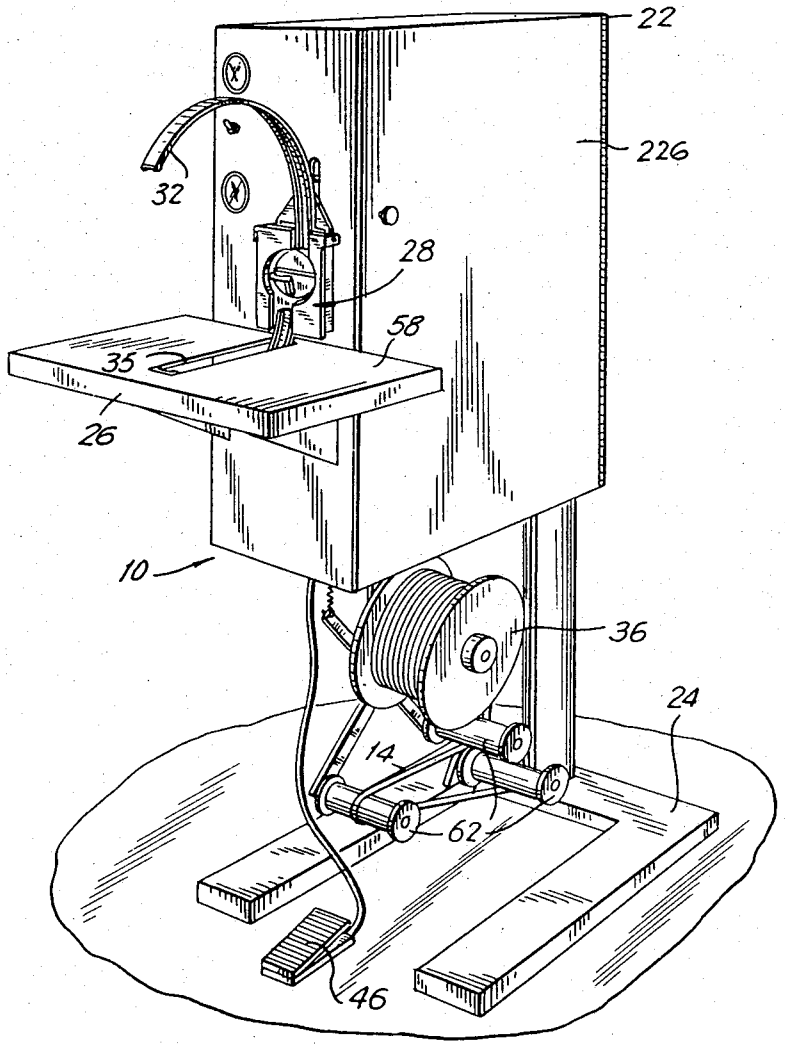
FIG. 1 is a perspective view of the twist tying machine in accordance with the invention.
Figure 10:
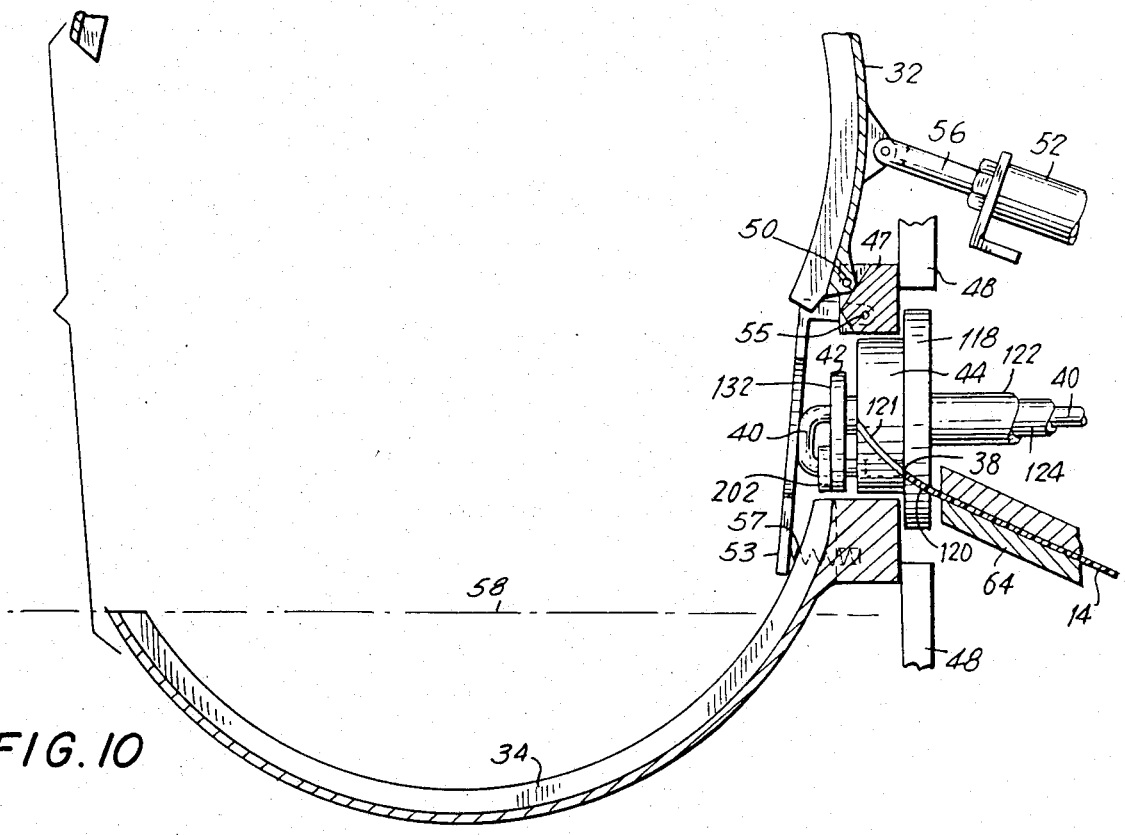
FIG. 10, 11 and 12 illustrate operational steps in enclosing a product with tie ribbon in the twist tying machine in accordance with the invention.

The normal inoperative state of the machine 10 is illustrated in FIG. 1 and FIG. 10. The door 226 is closed, as stated above, actuating a valve 228 whereby supply pressure by way of a regulator 229 pressurizes the pneumatic circuits and actuates the feed pressure cylinder 82 enabling friction drive of the tie ribbon 14 at the appropriate time. The upper ring 32 is in the elevated position. The ribbon 14 extends from the chute 64 with the leading end 38 in the slot 120 within the cutting plate 118 where it had been sheared in the previous tying operation of the machine.

The twister head 44 is fixedly oriented by engagement of the lock roller 182 in the notch 180 of the locking disc 176. This brings a slot 121 in the twister 44 into alignment with the slot 120 in the cutting plate 118 so that the ribbon 14 when feeding from the chute 64 can pass through both slots 120, 121 continuously. The first gripper 40 is spaced away from the second gripper 42 which in turn is spaced away from the twister head 44. The discharge opening of the slot 121 is positioned to feed the tie ribbon 14 into the space between the second gripper 42 and the twister head 44.

The product 12 is placed upon the surface of the work table 26 over an opening 35 in the table 26 exposing the lower ring 30. The operator then depresses the foot pedal 46 which closes the foot valve 231 to initiate operation. Operation of the foot pedal actuates a pilot valve 232 which applies air pressure to other system components. Operation is automatic thereafter until tying is completed and conditions are restored prior to the next cycle.

Figure 11:
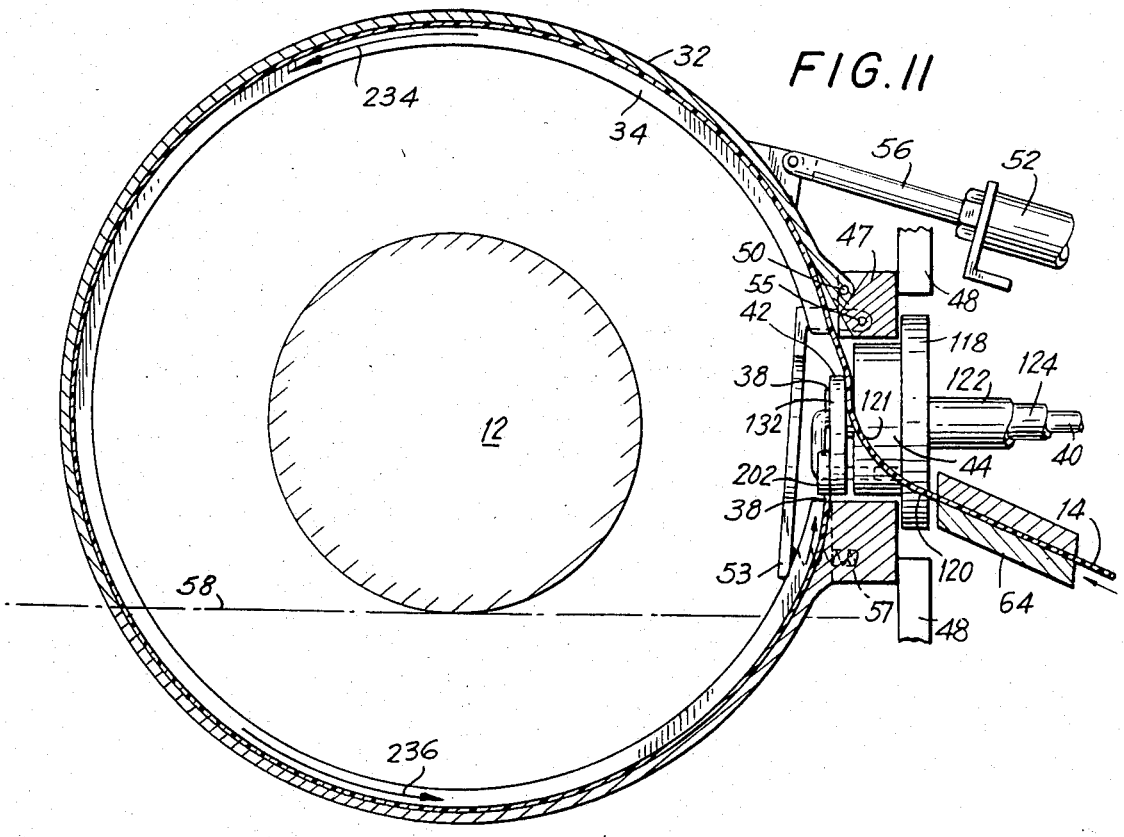
Figure 12:
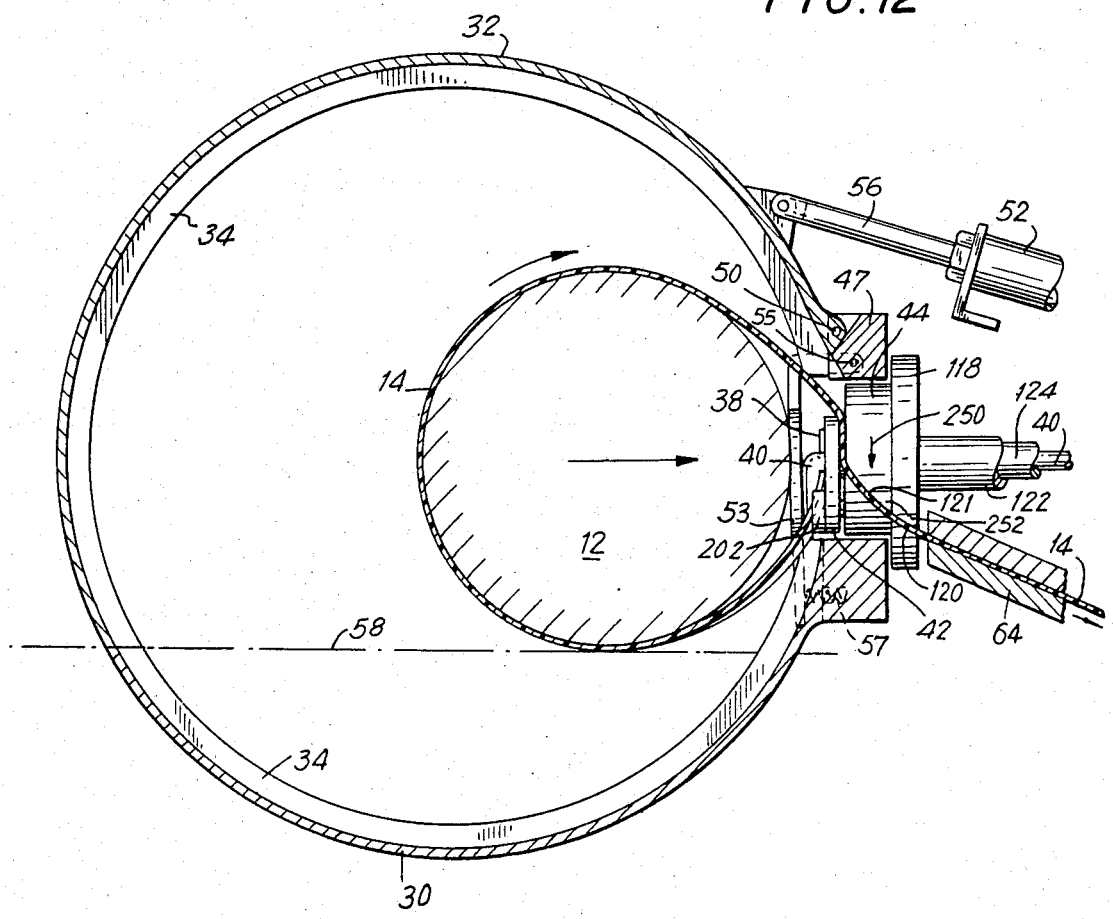

After operation of the foot valve 231, pressure is applied to the ring cylinder 52, extending the piston rod 56 and driving the upper ring 32 from its open position (FIGS. 1, 2, 3, 10) to the closed position illustrated in FIGS. 9, 11 and 12 to form a loop. As stated, the guide channels 34 in the upper and lower rings 32, 30 come together to form a continuous channel in the form of a helix. Operation of the ring cylinder 52 causes that device to pivot as the upper ring 32 moves into its operative position, thereby tripping the ring limit valve 60. Upon occurrence of this indication that the ring has closed, pressure is applied to the ribbon feed cylinder 96 causing the feed rack 86 to move upward (FIGS. 4, 5) whereby the pinion gear 88 rotates and causes the lower feed wheel 76 mounted on the common shaft 78 to rotate in frictional engagement with the tie ribbon 14, the tie ribbon 14 being compressed between the upper feed wheel 80 and the lower feed wheel 76.

As illustrated in FIGS. 9, 11 the tie ribbon 14 feeds fromm the cutting plate 118 through the slot 121 in the twister head 44, through the gap between the second gripper 42 and the twister head 44 to enter the channel 34 in the upper ring 32, moving around the helix in the direction indicated by the arrows 234, 236 until the leading end 38 of the tie ribbon 14 reaches the face surface 132 of the second gripper 42. The leading end 38 of the tie ribbon 14 then slides along the face surface 132 and the edge of the guide bar 202 and moves into the opening between the first gripper 40 and the second gripper 42.

Forward feeding of the tie ribbon 14, as described, ends when the rack 86 makes contact with the limit valve 92. Closing of the limit valve 92 actuates a four way valve 238 which in turn actuates the first gripper cylinder 144, causing the piston 158 to extend from the block 152 and driving the pin 143 fixed to the rod 40 to the right (FIG. 4) against the compressive force of the spring 140. By actuation of the first gripper cylinder 144, the gripper 40 moves against the second gripper 42 with the surface 130 on the first gripper 40 and the surface 132 on the second gripper 42 sandwiching the free end of the tie ribbon 14 therebetween, and retaining the ribbon end in that position.

Also, upon actuation of the limit valve 92 by the rack 86, the ribbon feed cylinder 96 is pressurized in reverse causing the rack 86 to move in the downward direction (FIG. 5) However, movement of the rack 86 and consequent rotation of the engaged pinion gear 88 does not per se cause the lower feed wheel 76 to rotate because the lower feed wheel 76 is mounted to the shaft 78 with a one-way rotation mechanism, similar to that illustrated in FIG. 6. Nevertheless, the lower feed wheel 76 is driven as the rack 86 moves down by application of pneumatic pressure to the duct 102 in the cylinder block 98, causing the piston 104 to extend from the cylinder block 98 and drive the clutch plate 113 into frictional engagement with a similar clutch plate 114 mounted on the lower feed wheel 76. The pin 112 extended through the shaft 78 rotates the clutch plate 113 as the pinion 88 rotates the shaft 78. Thereby, the lower feed wheel 76 is driven in a reverse direction from that originally feeding the tie ribbon 14 and as illustrated in FIG. 12, the loop of the tie ribbon 14 is reduced in diameter by drawing back the ribbon 14 between the second gripper 42 and the cutting head 44, back through the chute 64 and between the feed wheels 76, 80 where the excess ribbon becomes a portion of the ribbon feed train between the ribbon supply drum 36 and the chute 64 (FIG. 3).

The rack 86 moves down until its actuates the limit valve 240. However, before the rack 86 reaches this lowest position, the loop of the ribbon 14 closes about the product 12, greatly increasing the force required to retract additional tie ribbon 14 and causing slippage in the frictional engagement between the clutch plates 113, 114 used for driving the lower feed wheel 76 in the reverse direction. Therefore, by slipping the frictional clutch mechanism, damage to the tying machine 10 and to the product 12, where the product is compressible, such as food stuff, is prevented while at the same time the rack 86 achieves its initial starting position.

At the end of the return travel of the rack 86, the limit valve 240 is actuated, actuating a pilot valve 242, which in turn through a four way valve 244, applies pressure to the second gripper cylinder 164 through the supply duct 166, driving the second gripper 42 to the right (FIG. 4). The end of the second gripper tube 124 acts on the thrust bearing 126 causing the pressurized first gripper cylinder 144 to translate along the surface 170 of the frame 48, further compressing the spring 140 and causing the gripper 40 to remain in contact with the moving gripper 42 with the ribbon 14 held therebetween. Motion to the right of the second gripper 42 pinches the tie ribbon 14 between the second gripper 42 and the twister head 44. Thus, the ribbon 14 is held near its leading end 38 by the first and second grippers 40, 42 and at the other end of the loop, which has been closed around the product 12 by the second gripper 42 and twister head 44.

Substantially simultaneously, the four way valve 244 actuates the locking cylinder 196 causing the lock roller 182 to lift from the semi-circular notch 180 in the locking disc 176 attached to the twister tube 122. Thus, the twister tube 122, interconnected with the first gripper 40, second gripper 42 and twister head 44 by interengagement of the hooked end 138 of the first gripper 40, as described above, are free to rotate in unison about their common axis 206.

Actuation of the locking cylinder 196, as described, causes the linkage lever 186 to pivot, thereby actuating the limit switch 204. The limit switch 204 activates a pilot valve 244 which in turn drives the four way valve 248. Actuation of the valve 248 drives the twister cylinder 216 (FIG. 6) extending the plunger rod 214 to move the rack 212 upward. The pinion 208 of the one-way clutch 207 rotates, causing the twister tube 122 to rotate. Rotation of the tube 122 causes the connected twister head 44 to rotate in unison with the first gripper 40 and second gripper 42 interlocked therewith. The assemblage of grippers 40, 42 and twister head 44 rotate on the common axis 206 in the direction of the arrow 250 (FIG. 12) for two revolutions causing the tie ribbon 14 to twist about itself as indicated at 20 in FIG. 13. With the first turning motion of the twister head 44, the ribbon 14 is sheared by the edge 252 (FIG. 12) of the twister head 44 sliding relative to the cutting plate 118.

When the twister head 44 and grippers 40, 42 have completed 1½ revolutions, the rack 212 moving upward in the direction of the arrow 218 (FIG. 6) trips a limit switch 220 which causes the locking cylinder 196 to extend the plunger rod 194. The lock roller 182 moves to ride on the moving peripheral surface 224 of the locking disc 176 until the lock roller 182 falls into the notch 180 and prevents further rotation of the disc 176 and the twister head 44. Reverse actuation of the twister cylinder 216 then draws the rack 212 down to its original position. As the rack 212 moves downward the one way clutch 207 allows rotation of the pinion 208 in a direction opposite to that of the arrow 210. However, rotation of the pinion 208 in this reverse direction does not engage or rotate the twister tube 122. As stated above, the twister tube 122 is held in position by interaction of the lock roller 182 with the locking disc 176.

The product has now been tied with ribbon 14 and separated from the supply of tie ribbon 14. Pressure on the ring cylinder 52 is reversed at any convenient time in the cycle after the free end 138 of the ribbon 14 has been clamped so that the upper ring 32 is raised. When pressure is released from the first and second gripper cylinders 144, 164, the spring 140 returns the first and second grippers 40, 42 to the spaced-apart condition and the gripper cylinder 144 to the original position. The tied product is now easily removed from the table 26. Thus, the machine 10 is in condition to accept another product 12 to have a ribbon 14 tied therearound. The foot pedal 46, once actuated, can activate the machine 10 for continuous repetitive operation or a valve may be used which requires operation of the foot pedal to initate each cycle of operation.

It should also be understood that a trip valve may be incorporated in the table 26 or adjacent to the head assembly 28, for example, responding to motion of the guide bar 53, such that the product 12 being placed in position on the table 26 initates the operational cycle.

Use of pneumatic cylinder valves 144, 164 to position the grippers, and concentric passage of the gripper support members through these valves eliminates the need for a plurality of synchronized cams to operate the grippers. Fewer parts are required and a compact design is achieved. Wear of the gripping surfaces is automatically compensated since the stroke of the pneumatic valves self-adjusts to assure good gripper contacts with the ribbon. Similarly pressure on the ribbon 14 between the feed rollers 79, 80 is automatically maintained by the feed pressure cylinder 82, and withdrawal of ribbon 14 around the product 12 is reliably and adjustably performed by controlling the pressure applied to the cylinder block 98. As stated, use of a sliding connection at the pin 112 (FIG. 5) assures uniform operation of the reverse ribbon feed despite wear and temperature variations. Operation of the racks 86, 212 in two directions in conjunction with one-way pinion drive mechanisms, simplifies the pneumatic control system as well as the physical construction.

Different sized rings 30, 32 can be used to accommodate different products and a proper ribbon loop is fed in each case merely by resetting the position of the rack limit valve 92. No other adjustment is necessary to the machine 10. The friction clutch drive 98–114 assures uniform tightness of the tied ribbon 14 regardless of size variations in the product 12 and ribbon is not wasted.

It will thus be seen that the objects set forth above, and those made apparent from the preceding description, are efficiently attained, and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween

What is claimed is:

1. A ribbon feeder device for use in twist tying machines and the like wherein a tie ribbon is moved into an encircling relationship about a product, the device comprising:

chute means for guiding a tie ribbon as the ribbon is moved towards a product;

first feed wheel means extending into tangential rolling contact with a first surface of a tie ribbon in the chute means;

second feed wheel means extending into rolling contact with a second surface of a tie ribbon in the chute means, the first and second feed wheels cooperating to grasp the tie ribbon;

drive shaft means on which the first feed wheel means is rotatably mounted;

one-way clutch means between the first feed wheel means and the drive shaft means, the clutch means responding to rotation of the drive shaft means in one direction to couple rotation of the drive shaft means to the first feed wheel means to advance the ribbon in the chute means, the clutch means responding to rotation of the shaft means in the opposite direction to allow the first feed wheel means to free-wheel relative to the drive shaft means;

friction clutch means between the first feed wheel means and the shaft means for enabling reverse rotation of the first feed wheel means when the drive shaft means rotates in the opposite direction; and actuator means coupled to the friction clutch means, the actuator means responsive to a control signal when the shaft means is rotating in the opposite direction to actuate the friction clutch means for tightening the ribbon around the product.

2. The ribbon feeder device of claim 1 and further comprising:

regulator means coupled to the actuator means for setting the degree of frictional engagement of the friction clutch means at a predetermined level, whereby the degree of tension in the tightened tie ribbon is limited by slippage of the friction clutch to a predetermined level.

3. The ribbon feeder device of claim 1 in which the chute means comprises an enclosed channel having at least one aperture through which the first and second feed wheel means project to grasp the tie ribbon.

4. The ribbon feeder device of claim 3 in which the chute means further comprises:

a pair of mated plates having opposed surfaces, the enclosed channel being formed in at least one of the surfaces.

5. The ribbon feeder device of claim 2 in which the friction clutch means further comprises:

first friction plate means coupled to the one-way clutch means; and second friction plate means coupled to the drive shaft means.

6. The ribbon feeder device of claim 5 and further comprising:

coupling means between the second friction plate means and the drive shaft means for loosely coupling motion from the drive shaft means to the second friction plate means to accommodate dimensional variation of the feeder device due to a change in temperature, whereby the determined level of tension in the tie ribbon is not altered.

7. The ribbon feeder device of claim 6 in which the second friction plate means is slidably mounted on the drive shaft means and wherein the actuator means further comprises:

means coupled to the second friction plate for pressing the second friction plate means against the first friction plate means in response to the control signal; and means coupled to the drive shaft means for coupling rotation from the drive shaft means to the second friction plate means while permitting motion thereof along the drive shaft means.

8. The ribbon feeder device of claim 1 in which the actuator means further comprises:

a cylinder block, a piston, and a drive shaft coupling the piston to the friction clutch emans, the cylinder block comprising an annular cylinder chamber and containing a hole through which the drive shaft passes, the piston being annular and slidingly fitted in the annular cylinder chamber; and a conduit coupled to the cylinder chamber for coupling a drive fluid under pressure thereto to cause the piston to move the second clutch plate means into engagement with the first clutch plate means.

9. The ribbon feeder device of claim 1 and further comprising:

drive means coupled to the drive shaft means, the drive means rotating the drive shaft means continuously in one direction to feed the tie ribbon into the chute means, the drive means rotating the drive shaft means continuously in the opposite direction to tighten the tie ribbon around the product.

10. The ribbon feeder device of claim 9 in which the drive means further comprises:

pinion means coupled to the drive shaft means;

rack means engaged with the pinion means, the rack means supported for longitudinal motion back and forth relative to the pinion means to cause the pinion means to turn the drive shaft means in one direction or the other.

11. The ribbon feeder device of claim 10 and further comprising:

cylinder means located adjacent to the rack means, the cylinder means having two spaced-apart inlets for fluid under pressure;

piston means located between the inlets in the cylinder means, the piston means coupled to the rack means; and fluid supply means coupled to the inlets for supplying fluid under pressure into the cylinder via one or the other inlet so as to drive the rack means back and forth on the pinion means.

12. The ribbon feeder device of claim 10 and further comprising:

limit means adjacent to the rack means which is responsive to movement of the rack means to a predetermined position to limit longitudinal movement of the rack means.

13. The ribbon feeder device of claim 11 and further comprising:

limit control valve means contacted by the rack means at a predetermined position for cutting off the supply of fluid under pressure to the drive cylinder.

14. The ribbon feeder device of claim 1 in which the first feed wheel means is mounted on a first axle and the second feed wheel means is mounted on a second axle and in which the second axle is movable relative to the first axle and further comprising:

drive means connected between the first axle and the second axle for moving the second feed wheel means into contact with a tie ribbon on the first feed wheel means.

15. The ribbon feeder device of claim 14 in which the drive means further comprises:

a drive cylinder and a piston which is movable in the drive cylinder in response to the presence of fluid under pressure, the drive cylinder and the piston being connected between the axles, whereby admission of fluid under pressure to the cylinder urges the axles and, thereby, the first and second feed wheel means, together to grasp a tie ribbon.

* * * * *